US011466638B2

(12) United States Patent
Brinkman et al.

(10) Patent No.: US 11,466,638 B2
(45) Date of Patent: Oct. 11, 2022

(54) SENSOR DIAGNOSTIC PROCEDURE

(71) Applicant: Deere & Company, Moline, IL (US)

(72) Inventors: Jason E. Brinkman, Cedar Falls, IA (US); Joseph A. Bell, La Fontaine, IN (US); Curtis P. Ritter, Waterloo, IA (US); Mark A. Friedrich, Cedar Falls, IA (US); Michael J. Pipho, Dunkerton, IA (US)

(73) Assignee: DEERE & COMPANY, Moline, IL (US)

( * ) Notice: Subject to any disclaimer, the term of this patent is extended or adjusted under 35 U.S.C. 154(b) by 755 days.

(21) Appl. No.: 15/792,474

(22) Filed: Oct. 24, 2017

(65) Prior Publication Data

US 2019/0120159 A1 Apr. 25, 2019

(51) Int. Cl.

*F02D 41/22* (2006.01)
*F02D 41/00* (2006.01)
*F02D 41/04* (2006.01)

(52) U.S. Cl.

CPC ..... *F02D 41/222* (2013.01); *F02D 41/0055* (2013.01); *F02D 41/042* (2013.01); *F02D 2200/0406* (2013.01); *F02D 2200/0408* (2013.01); *F02D 2200/701* (2013.01); *F02D 2200/703* (2013.01)

(58) Field of Classification Search

None

See application file for complete search history.

(56) References Cited

U.S. PATENT DOCUMENTS 4,878,380 A 11/1989 Goodman
5,461,569 A * 10/1995 Hara ..... F02D 41/1495 123/198 D
7,769,534 B1 * 8/2010 Xu ..... F02D 41/1441 123/688
7,953,530 B1 * 5/2011 Pederson ..... G01M 15/05 701/31.7
9,194,321 B1 * 11/2015 Porlick ..... F02D 41/263

(Continued)

FOREIGN PATENT DOCUMENTS

CN 204360213 5/2015
DE 19721176 A1 12/1998

(Continued)

OTHER PUBLICATIONS

Machine Translation of JP-2016089663-A (Year: 2016).*

(Continued)

*Primary Examiner* — Navid Z. Mehdizadeh

(74) *Attorney, Agent, or Firm* — Michael Best & Friedrich LLP

(57) ABSTRACT

An engine diagnostic system includes a control system having a controller operatively connected to an engine. A monitoring system has a sensor operatively connected to the engine. A diagnostic system is operatively connected to the engine. The diagnostic system is configured to implement a sensor diagnostic procedure that includes a sensor health test. The sensor health test includes comparing a measured value of a sensor to an expected value and determining the health of the sensor based on the difference between the measured value and the expected value. The sensor diagnostic procedure can also include telematics data analysis.

20 Claims, 7 Drawing Sheets

(56) References Cited

U.S. PATENT DOCUMENTS

| | | | | |
|---|---|---|---|---|
| 9,702,315 | B1 | 7/2017 | Palmer | |
| 10,508,582 | B2 * | 12/2019 | Hall | F02D 41/029 |
| 2004/0002810 | A1 | 1/2004 | Akuzawa et al. | |
| 2006/0106509 | A1 | 5/2006 | Robb et al. | |
| 2006/0282200 | A1 | 12/2006 | Thiel et al. | |
| 2008/0059030 | A1 | 3/2008 | Quigley et al. | |
| 2008/0082228 | A1 | 4/2008 | Massen et al. | |
| 2008/0148827 | A1 | 6/2008 | Keski-Hynnila et al. | |
| 2008/0228337 | A1 | 9/2008 | Bauerle et al. | |
| 2009/0076716 | A1 * | 3/2009 | Han | F01N 13/0097 701/115 |
| 2009/0140872 | A1 * | 6/2009 | O'Neal | G05B 9/03 340/679 |
| 2010/0089364 | A1 | 4/2010 | Flanagan et al. | |
| 2010/0175656 | A1 | 7/2010 | Doub | |
| 2011/0029216 | A1 * | 2/2011 | Shibata | F02D 41/3035 701/101 |
| 2014/0007664 | A1 | 1/2014 | Ito et al. | |
| 2014/0238370 | A1 * | 8/2014 | Pursifull | F02D 41/222 123/690 |
| 2016/0025027 | A1 | 1/2016 | Mentele | |
| 2017/0211535 | A1 | 7/2017 | Priem et al. | |
| 2019/0010885 | A1 * | 1/2019 | Dudar | F02D 41/222 |
| 2019/0017427 | A1 * | 1/2019 | Dudar | F01N 11/002 |

FOREIGN PATENT DOCUMENTS

| | | | |
|---|---|---|---|
| DE | 10021639 | C1 | 1/2002 |
| JP | 2016089663 | A * | 5/2016 |

OTHER PUBLICATIONS

German Patent Office Action for Application No. 102018216240.9 dated May 9, 2019 (11 pages, statement of relevance included).

Office Action from the US Patent and Trademark Office for U.S. Appl. No. 15/413,844 dated Feb. 5, 2018 (6 pages).

* cited by examiner

SENSOR DIAGNOSTIC PROCEDURE

FIELD

Various exemplary embodiments relate to performing diagnostic tests to determine the health of engine sensors.

BACKGROUND

Modern engines are complex systems that can include numerous mechanical and electrical components. Due to these complex systems, complex monitoring and diagnostic testing are often required to detect and diagnose failures or errors in the engine. Certain engines are equipped with internal diagnostic systems. Internal systems however, may be limited in scope due to size, cost, or performance considerations associated with the engine. Technicians and service centers are often equipped with significantly more robust and sophisticated diagnostic capabilities. The size and remote location use of some machines or vehicles can make it impractical to bring to a service center, and the complexity of the systems can result in a technician that travels to the location of the machine having to spend a significant amount of time diagnosing the system and carry a large number of replacement parts to the location.

Systems and methods of improving the diagnosis and service of the engine (and entire machines) can reduce the amount of time it takes a technician to resolve an issue, as well as improve machine uptime and the customer experience. Due to the complexity of modern engines and the large number of potential underlying causes of a diagnostic issue, a technician must utilize sophisticated tools and follow multiple steps to diagnose a problem.

Diagnostic trouble codes can be caused by either an actual problem with the engine or by a faulty sensor measurement system reading, where the measurement system includes the wiring harness, electronic control unit A/D input, and the sensor, hereafter referred to as "sensor". Technicians often do not have the proper tools to diagnose a faulty sensor at a remote site, and will therefore remove and replace sensors just to eliminate potential causes of a problem. Once a sensor is removed and replaced, the technician is unlikely to go through the trouble to reinstall the original sensor, even if it is not faulty. This is especially true if the sensor was taken to a different location from the engine, for example a service center. Accordingly, there remains a need to be able to test and diagnose sensors in an on-board system.

SUMMARY

According to an exemplary embodiment, an engine diagnostic system includes a control system having a controller operatively connected to an engine. A monitoring system has a sensor operatively connected to the engine. A diagnostic system is operatively connected to the engine. The diagnostic system is configured to implement a sensor diagnostic procedure that includes a sensor health test. The sensor health test includes comparing a measured value of a sensor to an expected value and determining the health of the sensor based on the difference between the measured value and the expected value.

According to another exemplary embodiment, an engine diagnostic system includes a control system having a controller operatively connected to an engine. A monitoring system has a sensor operatively connected to the engine. A diagnostic system is operatively connected to the engine. The diagnostic system is configured to implement a telematics data analysis. The telematics data analysis includes storing data from a sensor and analyzing the sensor data over a time period to determine the health of the sensor.

Another embodiment includes a method of diagnosing an engine sensor. Sensor data is received at an engine control unit. The received sensor data is stored. A sensor diagnostic procedure is implemented that includes a telematics data analysis and a sensor health test. The telematics data analysis includes analyzing the stored sensor data over a time period to determine the health of the sensor. The sensor health test includes comparing the stored sensor data to an expected value and determining the health of the sensor based on the difference between the stored value and the expected value.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Figure 1:
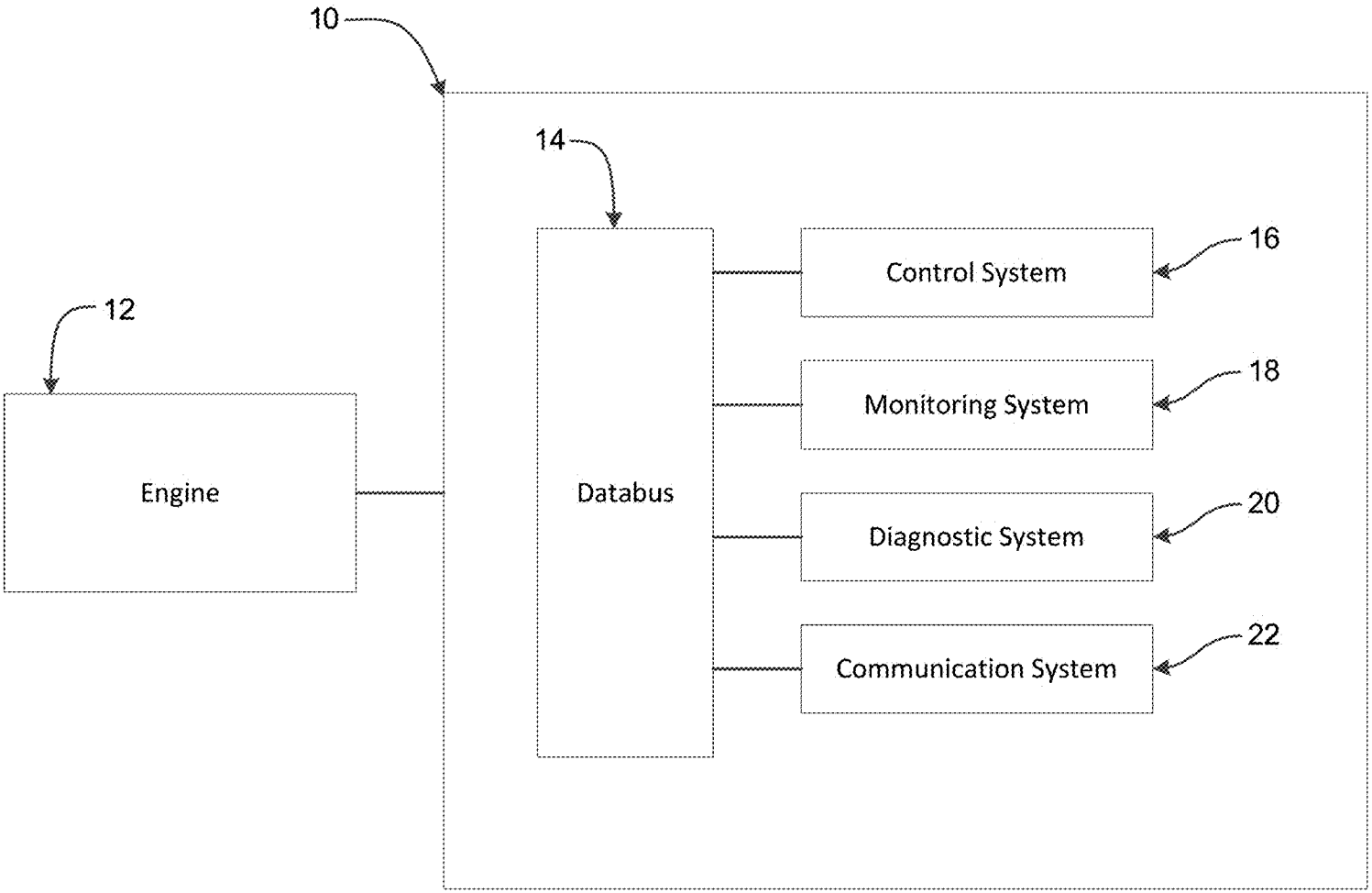
FIG. 1 is a schematic view of an exemplary engine electronic system.

FIG. 1 shows an exemplary embodiment of an electronic processing system 10 that is connected to an engine 12. The engine 12 can be part of a vehicle that contains one or more ground engaging members, for example tires or treads, that are powered by the engine. Alternative embodiments can be directed to other types of moving or stationary machines that utilize an engine, for example a diesel engine used in a generator.

In the exemplary embodiment shown in FIG. 1, the electronic processing system 10 includes a data bus 14 in communication with various components including a control system 16, a monitoring system 18, a diagnostic system 20, and a communication system 22. The electronic system 10 is configured to diagnose or at least partially diagnose different error conditions in the engine 12.

Modern engines require sophisticated tools for diagnostics and service. There are many steps a technician must follow to diagnose an engine problem such as visual inspection, gathering data, or utilizing diagnostic tools. According to an exemplary embodiment, the diagnostic system 20 is connected to or integrated with the electronic system 10 to perform interactive tests and calibrations, such as a harness diagnostic test or injector calibration string input. By retrieving information and performing interactive tests locally and transmitting the data remotely, unnecessary diagnostic procedures can be eliminated or minimalized, allowing a technician to arrive at the machine with the right parts or a reduced range of parts.

The electronic processing system 10 can include one or more of a data processor and data storage component. The electronic processing system 10 can be implemented by a general purpose computer that is programmed with software modules. The data bus 14 provides communication between the different components. The control system 16 can include one or more controllers or electronic control units, for example an engine control unit. The control system 16 can include software and/or firmware stored in memory to perform different operations and tasks.

The monitoring system 18 can include various sensors or other measurement devices used to monitor the status of components in the engine. For example, the monitoring system can collect voltage information associated with different sensors, and this information can be compared to stored values in a chart or table. Based on discrepancies between the actual and stored values, error codes or diagnostic trouble codes (DTCs) can be generated, either by the control system 16 or the diagnostic system 20.

The diagnostic system 20 can be configured to perform multiple tasks, including initiating tests and recording errors sensed by the monitoring system 18. The diagnostic system 20 can receive and record, for example through a software module or instructions for analyzing, the results of diagnostic tests, fault codes, error messages, status messages, or test results provided by the monitoring system 18. The diagnostic system 20 can also be capable of analyzing or comparing the information provided by the monitoring system 18 to a database that contains prior information related to the engine and standard operating information. The diagnostic system 20 can record and store data associated with the engine, and transfer that data via the communication system 22 to a local output and/or a remote location. A local output can be a screen or other user interface associated with the system 10 or a user access device that is connected to the system, for example through hard wired connection, such as an RJ45 connection, or through a wireless connection such as Wi-Fi, Bluetooth, or other near field communication. A remote location can include transferring data via the communication system 22 over a network to a dealer or service center.

Locally, the information can be processed by an access device, such as a technician computer. The technician may also be able to access a controlled menu via an onboard computer system. At a remote location, the service center can receive the transmitted data and then process the data to provide a recommendation to a technician. The data can be processed by one or more data processing systems that can include a server, central processing unit, software modules or programmable logic, and electronic memory. In certain instances, the recommendation identifies a reduced number of potential sources of the problem from the maximum potential sources to allow the technician to carry fewer parts or less equipment when visiting a location. The diagnostic system 20 also may be capable of producing, storing, or communicating DTCs.

The electronic processing system 10 can utilize other components including processors, data storage, data ports, user interface systems, controller area network buses, timers, etc., as would be understood by one of ordinary skill in the art.

The electronics system 10 is configured to perform a sensor diagnostic procedure 100. Sensors are used to monitor one or more engine components. Signals generated by sensors are sent to the control system 16 which uses the data provided to monitor and control the operation of the engine. For example, an intake manifold air pressure (MAP) sensor (sometimes referred to manifold absolute pressure sensor) provides intake manifold pressure data to the control system 16. The manifold pressure information is used to determine how much fuel needs to be fed to each cylinder in the engine and is also used to determine injection timing. Because removing a MAP sensor and measuring its output on a test unit to get a voltage vs. pressure curve is undesirable, the MAP Sensor test is performed to get as many data points as practical to get a reasonable confidence level that the sensor is good or defective. This confidence level can be expressed in a percentage value or given some other indication.

The communication system 22 is configured to locally and remotely communicate information over a communication network. The communication system 22 can provide communication over different wired or wireless systems and networks including mobile, satellite, Wi-Fi, near-field, Bluetooth, or a combination thereof as needed. In an exemplary embodiment, the communication system 22 is a telematics system. The telematics system includes, for example, a network of regional, national, or global hardware and software components. In addition, the telematics service may be provided by a private enterprise, such as an independent third-party company that provides the service to other companies, a manufacturing company that provides the service to its customers, or a company that provides the service to its own fleet of vehicles. Alternatively, the telematics service may be provided by a governmental agency as a public service. JDLink™ is an example of a telematics service, which is available from John Deere & Company.

Figure 2:
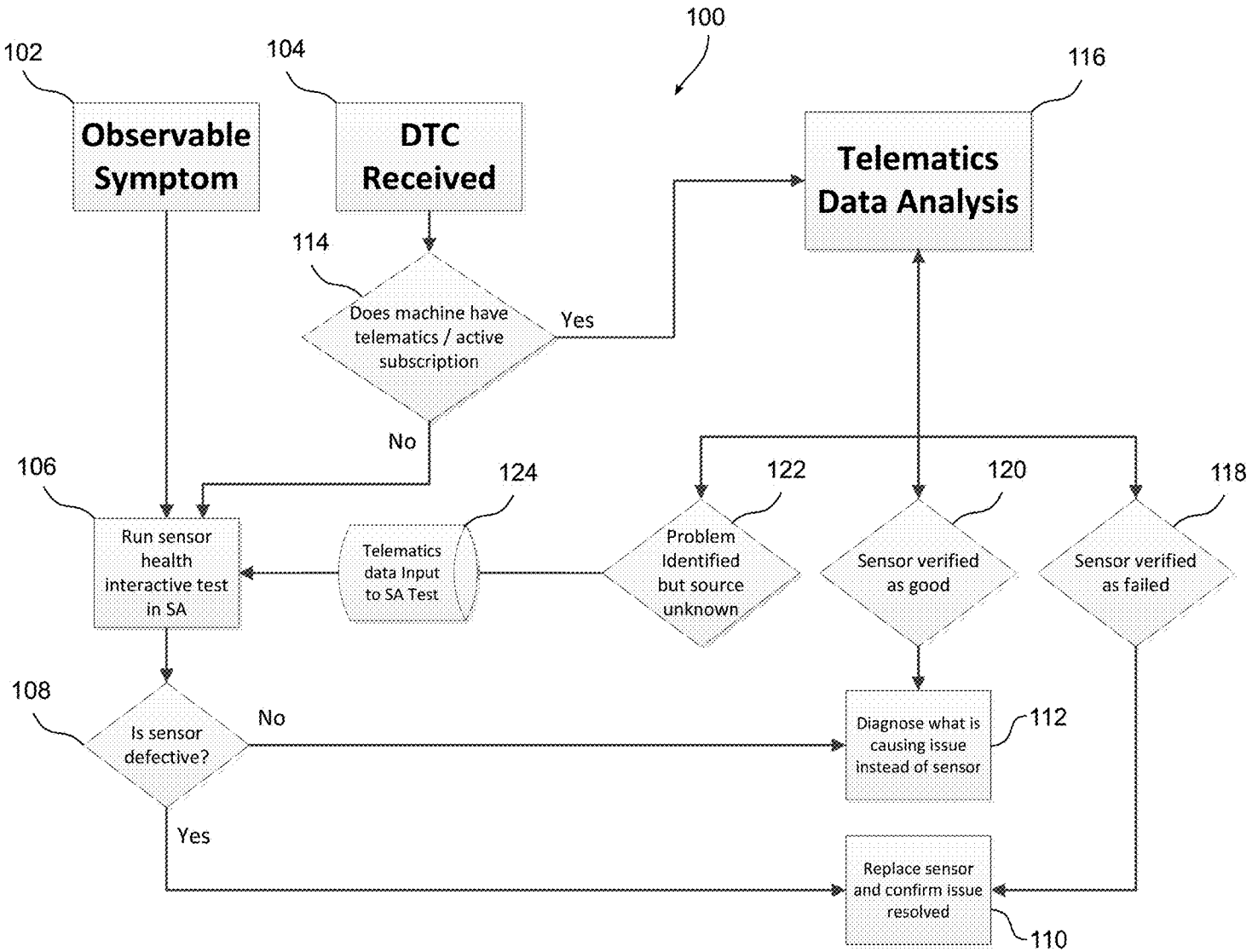
FIG. 2 is a flow chart illustrating an exemplary method of performing a sensor diagnostic.

FIG. 2 shows an exemplary embodiment of the sensor diagnostic procedure 100. The sensor diagnostic procedure 100 can be implemented based on an observable symptom (step 102) or by receipt of a DTC (step 104). If the problem was observed, the user can initiate a sensor health test (step 106). During a sensor health test (step 106), the diagnostic system 20 causes one or more engine components to operate under varied conditions and monitors and records the output of one or more sensors. The conditions can include normal operating conditions for the engine as well as non-normal operating conditions.

For example, the sensor health test (step 106) can implement an operating condition that is designed to create or mimic causing certain engine components to operate outside of normal values or ranges. This can include shutting down or disconnecting certain components of the engine, disrupting the timing of certain engine components, and causing certain engine components to operate outside of normal values or ranges. The operating condition modifications can be done automatically by the system or a person running the test can perform these actions. The output of the sensor(s) under the varied conditions is compared to a set of expected values. The expected values can be stored in a database and compiled from prior tested values or expected calculated values. The expected values can also be obtained from a physics-based model which is calculated by the electronic control unit using information form other sensors.

Figure 7:
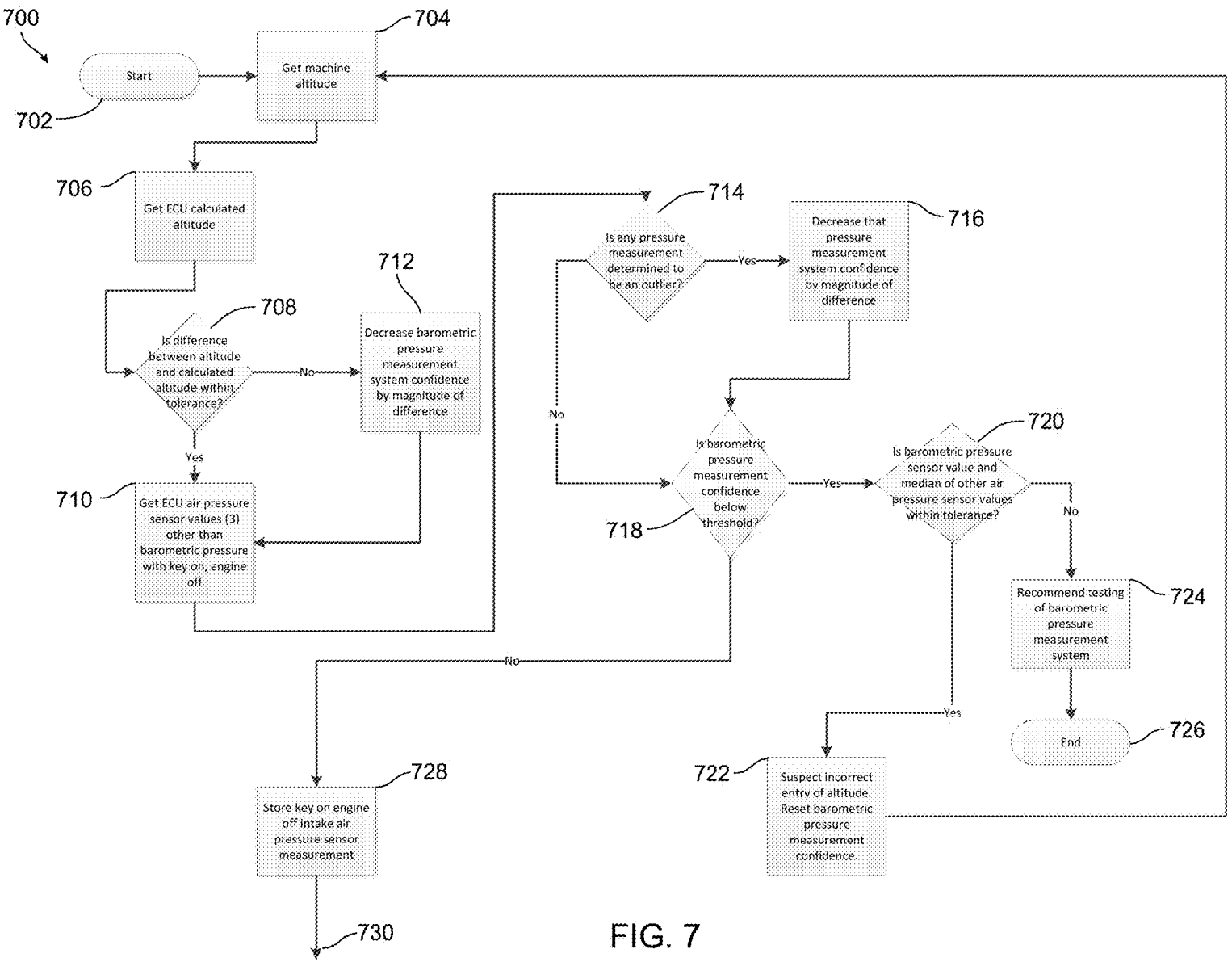
FIG. 7 is a flow chart illustrating a first portion of an exemplary sensor health test for a manifold air pressure sensor.
Figure 8:
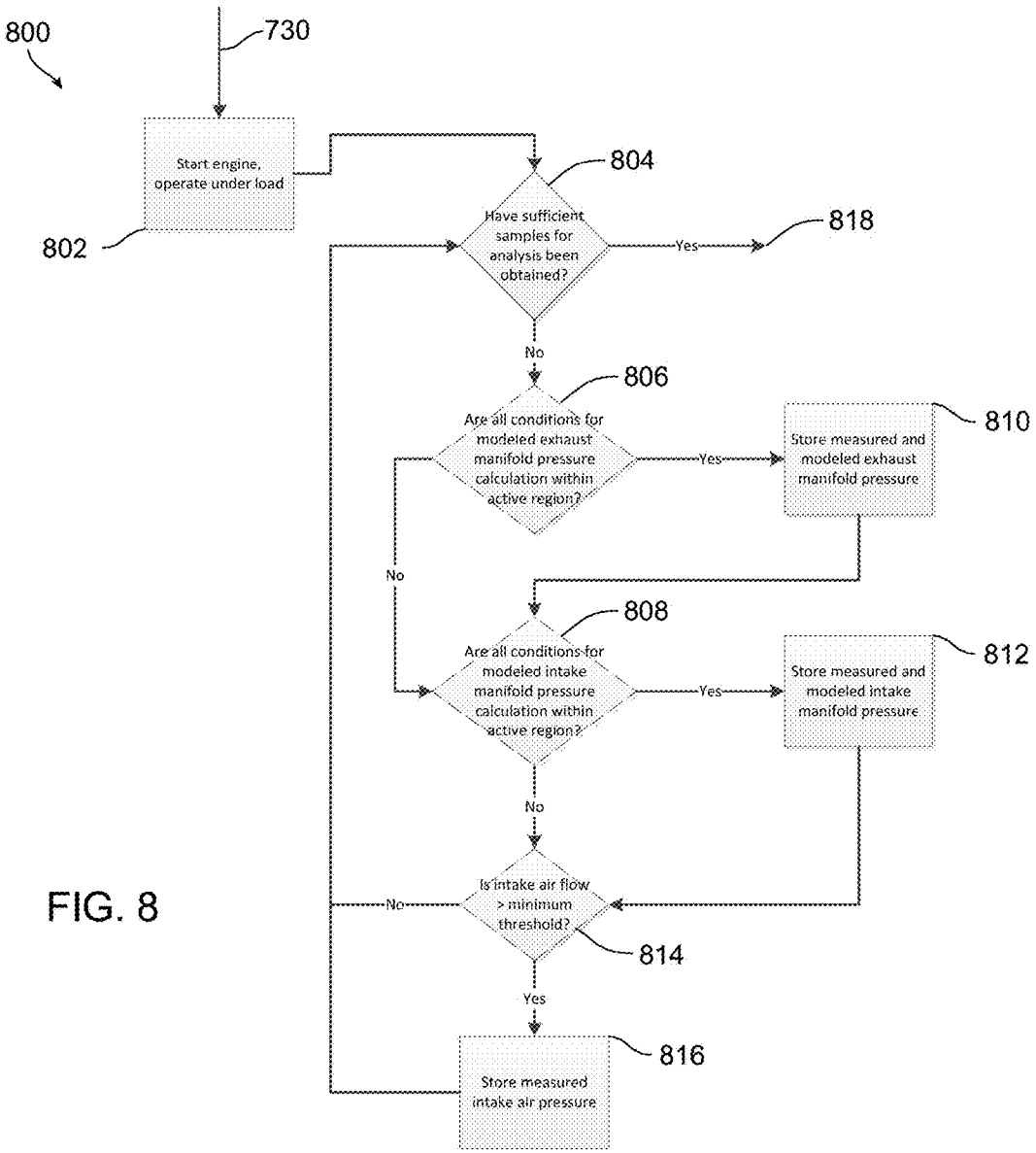
FIG. 8 is a flow chart illustrating a second portion of an exemplary sensor health test for a manifold air pressure sensor.
Figure 9:
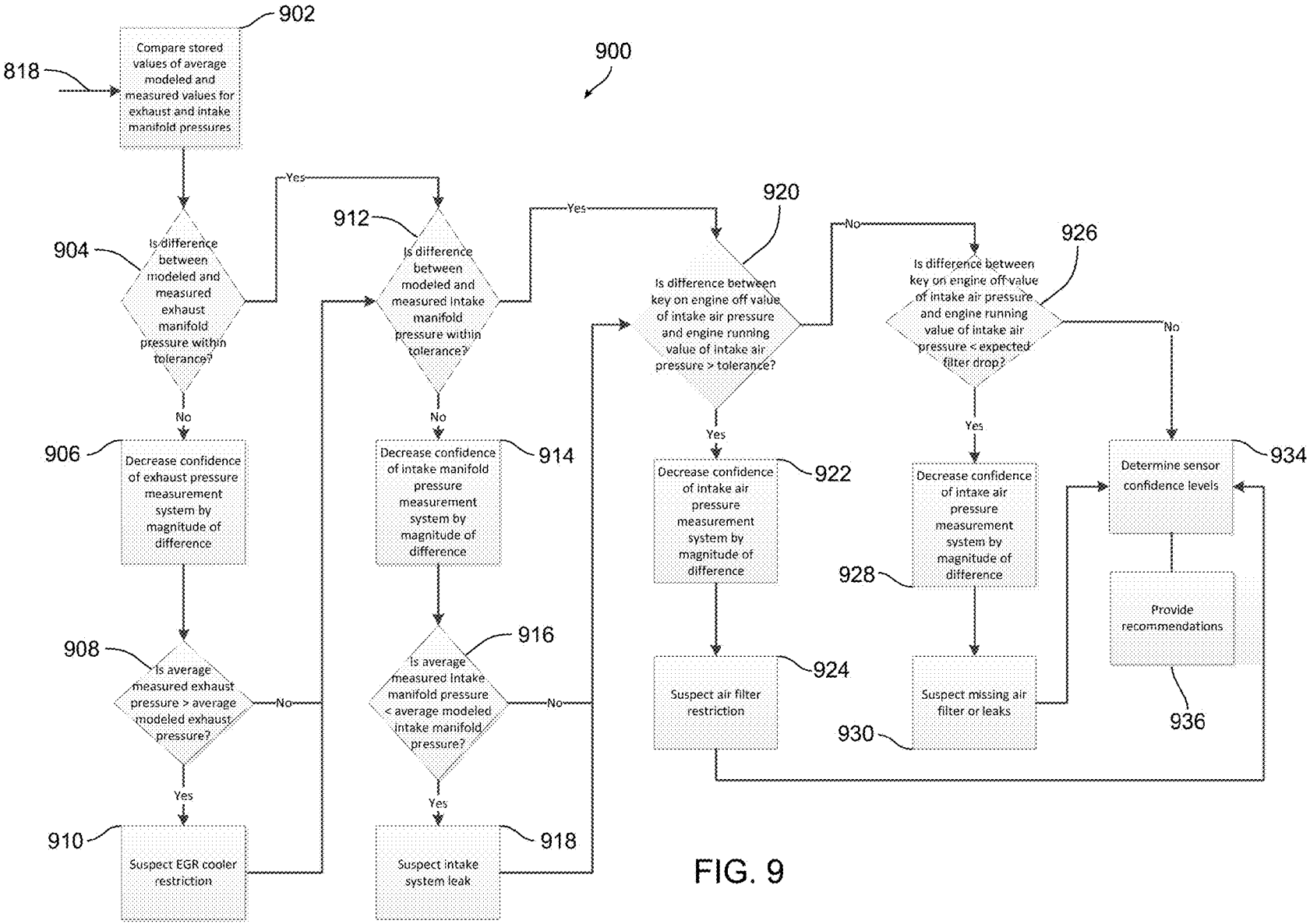
FIG. 9 is a flow chart illustrating a third portion of an exemplary sensor health test for a manifold air pressure sensor.

The expected values can also be determined by taking readings from other active sensors that are monitored during the diagnostic procedure. The health of the sensor can be determined based on any differences between the measured and expected values to determine if a sensor is defective (step 108). A specific example of a sensor health test (step 106) is illustrated in FIGS. 7-9 and described in greater detail below. If the sensor is defective, it is replaced and a confirmation can be performed to insure the issue is resolved (step 110). If the sensor is not defective, additional diagnoses are performed to determine what is causing the problem (step 112).

If a DTC is received (step 104), the system determines if the machine has an active telematics system (step 114). If the machine does not have active telematics system, the sensor health test (step 106) is performed. If the machine does have active telematics, a telematics data analysis is performed (step 116). Machines with telematics capability send data back continuously that can be analyzed manually or automatically to determine if a sensor is defective or good, to provide guidance on another issue or fault, or to provide preliminary input to the sensor health test (step 106). Data can be analyzed immediately, but also stored and compared over time. A specific example of a telematics data analysis (step 116) is illustrated in FIGS. 3-6 and described in greater detail below. While observing a symptom (step 102) and receiving a DTC (step 104) are shown as implementing different procedures, both may be capable of going directly to the sensor health (step 106) or to a telematics analysis (step 116).

If the telematics data analysis (step 116) determines that the sensor is defective (step 118) it is replaced and a confirmation can be performed to insure the issue is resolved (step 110). If the sensor is good (step 120), additional diagnoses are performed to determine what is causing the problem (step 112). If telematics data analysis (step 116) cannot determine if the sensor has failed or is still good (step 122) the data can be input (step 124) for use with the sensor health test (step 106).

Figure 4:
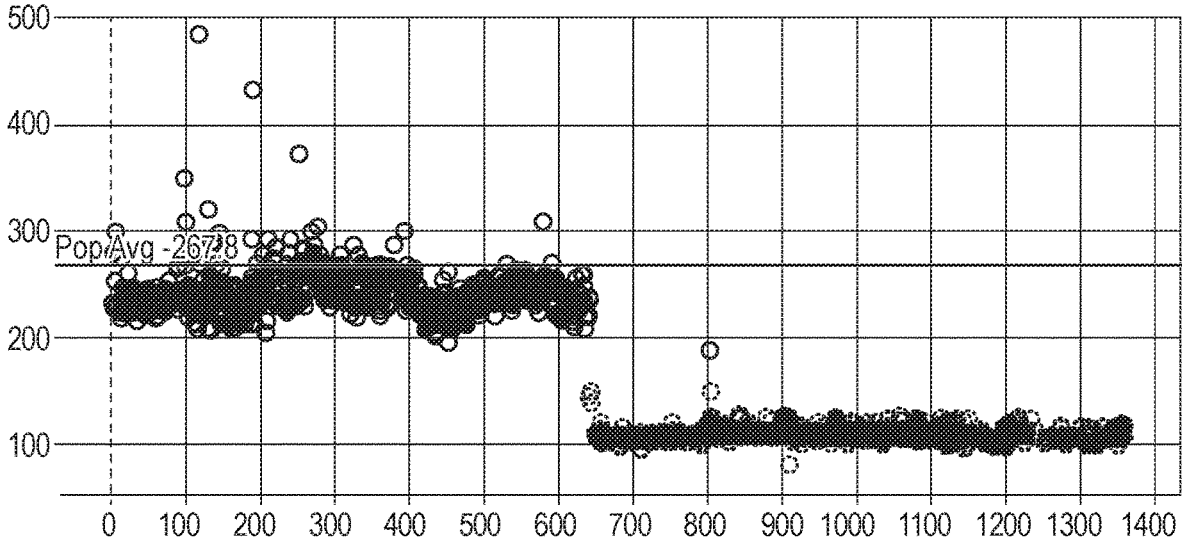
FIG. 4 is a graph illustrating an analysis of sudden shifts in data.
Figure 5:
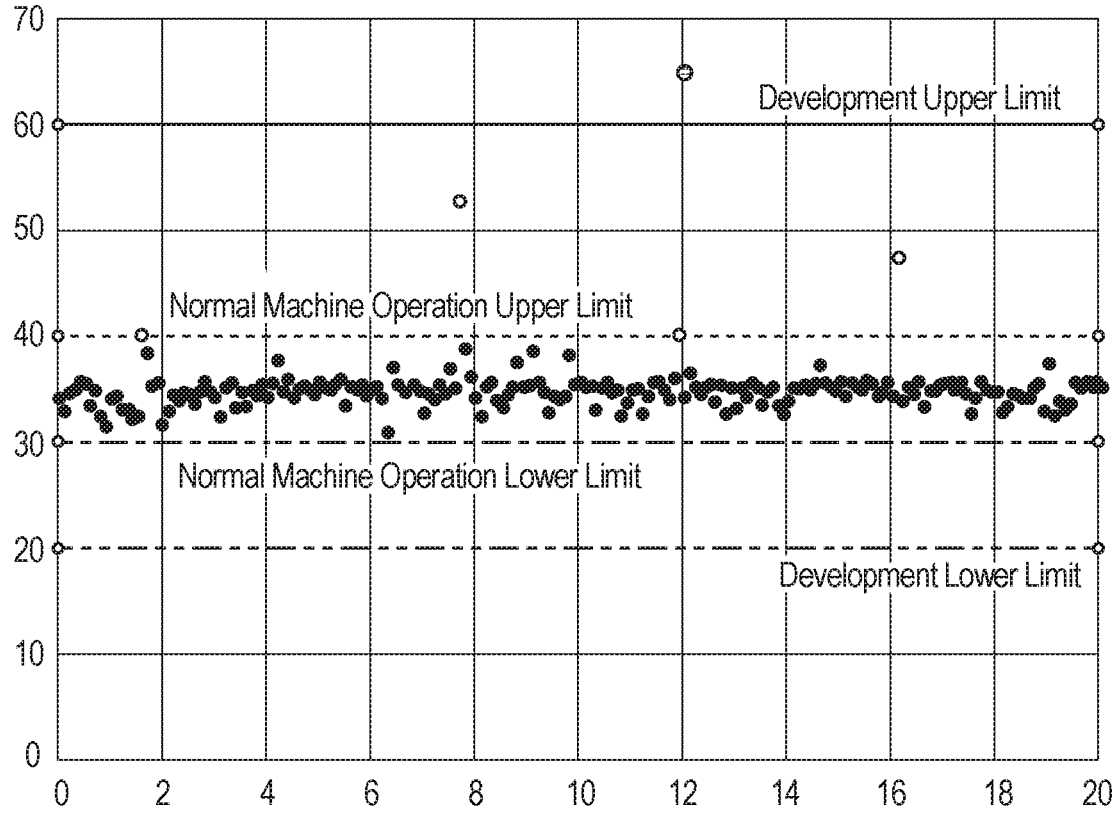
FIG. 5 is a graph illustrating an analysis of data exceeding a threshold.
Figure 6:
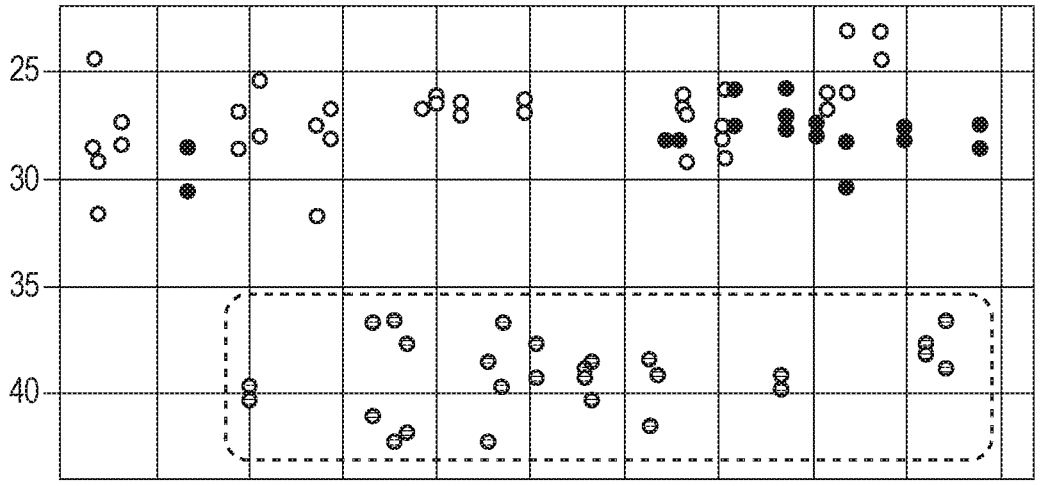
FIG. 6 is a graph illustrating an analysis of data compared to other similar machines.

FIGS. 3-6 show different data graphs that can be used as part of the telematics data analysis 116. In this embodiment, four areas of telematics data are used: data shifts over time (FIG. 3); sudden shifts in the data (FIG. 4); data exceeding a threshold (FIG. 5); and data compared to other similar machines (FIG. 6). This example pertains to the manifold air pressure (MAP) sensor, but the process also works for other pressure sensors, and can be adapted for other types of sensors.

A machine sends data back to servers for analysis through a telematics system connected through cellular, satellite, Wi-Fi, hard wired connection, or any other available communication technologies. During key on, engine off status, and machine temperature at ambient conditions, a comparison is made between the MAP sensor and other pressure sensors on the engine. The barometric pressure sensor is also compared over time versus GPS elevation data. Sensor comparisons can be done under steady state conditions, as well as in transient conditions while monitoring frequency response or rate of change in the sensor, that can indicate it is defective or not, or that another issue needs to be diagnosed.

During various speed and load conditions where the estimated MAP sensor values are known to be highly accurate, the estimated value is compared to the actual MAP sensor data. The engine could be running in a non-EGR (Exhaust Gas Recirculation) region at idle, as well as during conditions where EGR is flowing. This can also be done during exhaust after-treatment regeneration conditions since the engine would be operating in additional regions where comparisons can be made. Data captured includes engine speed, load, various temperatures and pressures, and additional parameters to confirm the engine is running in the proper region for analysis.

If the MAP sensor shows a deviation of a predetermined amount, a notification can be sent to appropriate personnel for action. This could be at a Technical Assistance Center, Engineering Department, Dealership Service Manager or technician, or any other appropriate personnel to take action as appropriate. Notification could be accomplished via an email, SMS, support dashboard, diagnostic tool, or any other applicable method.

Figure 3:
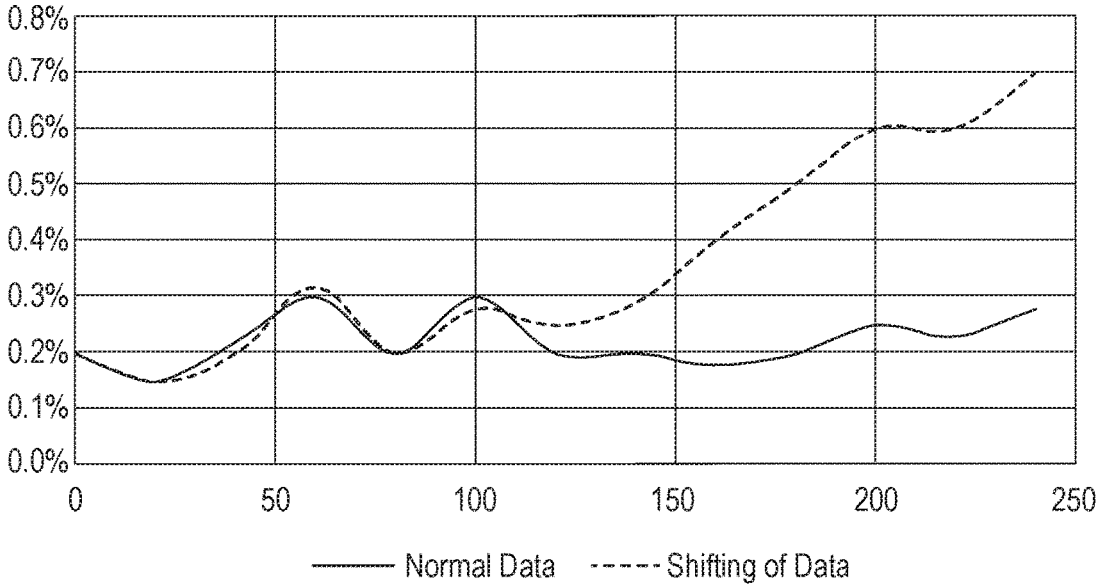
FIG. 3 is a graph illustrating an analysis of data shifts over time.

One comparison is to look at data shifts over time. For example, if the sensor reading begins to shift under the same conditions as previous points in time, it may be failing or indicate another issue to be diagnosed. FIG. 3 shows a comparison of expected sensor data vs data that is shifting over time. Normal data is the solid line and shifting data is the dashed line.

Another comparison is to detect sudden shifts in the data. FIG. 4 illustrates one example where, under steady state conditions, the sensor reading drops or increases significantly from an expected value.

Data from the sensor exceeding a threshold is another available comparison as illustrated in FIG. 5. In this case, the data falls outside of a predetermined acceptable range for the sensor. This could be an upper or lower limit. The limits could be from development data, or new limits could be determined based on the machine's historical data. The data points above the "Normal Machine Upper Limit" line represent values outside of historical data for that machine. The data points above the "Development Upper Limit" represents a value exceeding specifications.

Sensor health can also be determined based on machine data compared to other similar machines operating at the same time and under the same or similar conditions. If the sensor readings vary significantly from other machines, it may indicate an issue. This can be done instantaneously or over time. FIG. 6 illustrates sensor data from three machines. The cluster of dots inside the dashed box represents data from a suspect sensor.

FIGS. 7-9 show an embodiment of the sensor health test 106 that can be performed by the diagnostic system 20. FIG. 7 illustrates a first portion 700 of the sensor health test 106 that utilizes a barometric pressure measurement confidence value to help determine the health of manifold sensors. With a machine in a key on, engine off, starting state (step 702) the diagnostic system 20 obtains all applicable pressure sensor measurements. All sensors should be indicating absolute pressures that are near the actual barometric pressure. A comparison to the elevation of the machine as indicated by the barometric pressure sensor and the elevation of the machine can also be used to validate the accuracy of the barometric pressure sensor. In the key on, engine off state, the diagnostic system may also gather and compare data from other sensors.

The machine altitude is obtained (step 704), for example as determined by technician input or as obtained by GPS data for telematics-equipped machines. The engine control unit (ECU) altitude is obtained (step 706) from a barometric pressure sensor that is in communication with the ECU. The ECU calculated altitude is compared to the machine altitude to determine if there is a difference (step 708) that is out of a normal tolerance range. If the ECU and machine altitudes are within tolerance, then the other ECU air pressure sensor values are obtained (step 710). If the ECU and machine altitudes are not within tolerance, the confidence in the barometric pressure system is decreased by the magnitude of difference (step 712) and then the other ECU air pressure sensor values are obtained (step 710).

Next it is determined if any of the pressure measurements are outliers (step 714). If there is an outlier, the confidence in the barometric pressure system is decreased by the magnitude of difference (step 716) before proceeding to determine if the barometric pressure measurement confidence is below a certain threshold (step 718).

If the barometric pressure measurement confidence is below a certain threshold then it is determined if the barometric pressure sensor values and the median of the other air pressure sensor values are within a tolerance (step 720). If the barometric pressure sensor values are within tolerance, then it is likely that there was an incorrect entry of altitude data, and the barometric pressure measurement confidence is reset (step 722) and the machine altitude is re-calculated (step 704). If the barometric pressure sensor values are not within tolerance (e.g., when compared to the median value of the other pressure sensors), a recommendation is provided to test the barometric pressure measurement system (step 724) and the diagnostic is ended (step 726).

If the barometric pressure measurement confidence is above the threshold, then the pressure sensor measurements are stored (step 728) and the diagnostic procedure is continued (step 730). Because this check is only validating the accuracy of the pressure sensor when measuring barometric pressure, the sensor could still be faulty when tested at increased pressures.

FIG. 8 illustrates a sensor health test second portion 800. In the second portion 80o the engine can be operated under certain speed, load, and air system actuator positions (step 802) where the physics-based models used to determine an estimate of the MAP and exhaust manifold absolute pressure (EMAP) are known to be highly accurate. This can be performed during normal operation for some engine applications, applying an external load (i.e., PTO dynamometer or load bank), or by verifying desired conditions are met by capturing the appropriate data via telematics. Because there may be only a small operating test region where all conditions for an accurate estimate calculation are met, the test could prompt the technician regarding what changes to the current operating conditions are required to put the engine into the appropriate test region. For example, if the current load applied to the engine is determined to not be sufficient, the technician would be prompted to increase the load.

A determination is made to see if sufficient samples have been obtained to create a statistical average (step 804). If not, it is determined if all the conditions for the modeled EMAP are within the operating test region (step 806) and if all the conditions for the modeled MAP are within the operating test region (step 808). If all the EMAP condition are in the operating test region, the values of the measured and modeled EMAP are stored (step 810) and the diagnostic proceeds to the MAP conditions (step 808). If all the MAP condition are in the operating test region, the values of the measured and modeled MAP are stored (step 812).

Next, the sensor health test 106 determines if the intake air flow is above a minimum pressure (step 814). If the air intake is not above a minimum pressure, the diagnostic returns to determine if sufficient samples for analysis have been obtained (step 804). If the air intake is above a minimum pressure, the measured intake air pressure value is stored (step 816) and the diagnostic returns to determine if sufficient samples for analysis have been obtained (step 804). Once sufficient samples of measured and estimated MAP and EMAP sensors are obtained to create a statistical average (step 804), the diagnostic proceeds (step 818) to the third portion 900 of the sensor health test 106 shown in FIG. 9.

FIG. 9 illustrates a third portion 900 of the sensor health test 106 that compares the averaged stored modeled and measured values for the EMAP and MAP (step 902). If the error between the average measured and modeled pressures during engine operation are all within an established tolerance and the sensors also correctly indicated the measurement of barometric pressure with key on, engine off, then there is a high degree of confidence that the MAP and EMAP sensors are correctly measuring pressure. This may also be used to determine that there are likely no mechanical problems with the air intake and exhaust system such as leaks or restrictions. Thus the technician can ascertain that the MAP and EMAP sensors are not the source of the complaint.

In the comparison, it is determined if the difference between the modeled and measured EMAP is within a set tolerance (step 904). If it is not within the tolerance, the confidence of the EMAP measurement system is decreased by a magnitude of the difference between the measure and modeled values (step 906) and it is determined if the average measured EMAP is greater than the modeled EMAP (step) 908. If the measured value is greater, a recommendation is made that there is a suspected EGR cooler restriction (step 910).

In the comparison it is determined if the difference between the modeled and measured MAP is within a set tolerance (step 912). If it is not within the tolerance, the confidence of the MAP measurement system is decreased by a magnitude of the difference between the measure and modeled values (step 914) and it is determined if the average measured MAP is less than the modeled MAP (step) 916. If the measured value is less than the modeled value, a recommendation is made that there is a suspected intake system leak (step 918).

In the comparison it is determined if the difference between the key on engine off intake air pressure value and the engine running intake air pressure value is greater than a set tolerance (step 920). If it is greater than the tolerance, the confidence of the intake air pressure measurement system is decreased by a magnitude of the difference between the measure and modeled values (step 922). If the engine running intake air pressure is substantially less than the key on engine off intake air pressure, a recommendation is made that there is a suspected air filter restriction(step 924).

If the difference between the key on engine off intake air pressure value and the engine running intake air pressure value is less than a set tolerance (step 926), the confidence of the intake air pressure measurement system is decreased by a magnitude of the difference between the measure and modeled values (step 928) and a recommendation is made that there is a suspected missing or leaking air filter (step 930).

If the error between the average measured and expected pressures during engine operation are not within an established tolerance, the test 106 uses logic to attempt to determine the cause. For example, in cases where both the MAP and EMAP sensors indicate significant error between measured and modeled pressure and the direction of the error for measured MAP and modeled EMAP are the same, then it is possible that MAP sensor measurement error is causing the error between measured and estimated EMAP. This is due to an assumed change in the density of the intake air, which feeds into the EMAP physics-based estimated pressure. However, the measured EMAP is not a significant factor in calculating the estimated MAP, so an error in only the EMAP measured versus estimated pressure would indicate the problem is likely only associated with the exhaust system or EMAP sensor.

The confidence in the applicable sensor is reduced if it is determined to be suspect based on error between measured and modeled pressures and the test applying logic to isolate the suspect system (steps 906, 914, 922). This confidence is combined with the key on, engine off confidence established by the sensor's measurement of barometric pressure. If the overall confidence in the sensor is below a threshold, then the technician is informed by the test that the MAP or EMAP measurement system (e.g. sensor and wiring) is suspect (step 934).

There can be other causes of significant error between measured and estimated pressures besides a faulty sensor. For example, a leak in pressurized intake air system (boost leak) can cause the measured MAP to be lower than the estimated MAP. This can also cause an error between measured and estimated EMAP as described earlier. Therefore, the test could indicate that the technician should inspect for intake air leaks prior to replacing the MAP sensor.

Finally, all recommendations can output to a user (step 936) and the sensor health test 106 is completed.

Although manifold pressure sensors are discussed above, additional embodiments are related to determining sensor health for other engine systems that can be performed using a live connection or telematics data.

One alternative example includes, running the engine at idle (e.g., <1000 rpm) to be in a non-EGR region (check EGR valve state) and comparing the Manifold Air Pressure sensor (MAP) actual and estimated readings or other sensors as appropriate.

Another example includes, running the engine under various speed and load conditions and comparing the actual values to estimated values of engine sensors. This can be performed in normal operation for some engine applications, applying an external load (i.e., dynamometer or load bank), or by verifying desired load and speed conditions are met by capturing the appropriate data via telematics.

Another example includes, observing the rate of change or frequency response for pressure sensors under different operating conditions.

Another example includes, observing individual sensor pressure or delta pressure values that have a consistent offset with each other under specific conditions.

Another example includes, adjusting the Exhaust Gas Recirculation (EGR) modes and comparing the values of the Exhaust Manifold Pressure sensor (EMAP) to the MAP sensor.

Another example includes the use of intrusive diagnostics where a technician disconnects an engine sensor, valve, or actuator and compares the actual values to estimated values of engine sensors. For example the technician can disconnect the EMAP sensor.

Another example includes the use of intrusive diagnostics where test commands are given to modify actuator and valve positions and the actual values of engine sensors are compared to estimated or modeled values. For example, Variable Geometry Turbo (VGT) position, EGR valve position, air throttle position, exhaust throttle position, dosing valve position, and/or Diesel Exhaust Fluid (DEF) control valve position.

Another intrusive diagnostic test can include altering the engine running state to control different operating modes and comparing the actual and estimated values of engine sensors. The different operating modes can include, EGR Mode, Fuel Mode, and Force Exhaust Temperature Management (ETM).

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present disclosure, and are not intended to limit the structure of the exemplary embodiments of the present disclosure to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. An engine diagnostic system comprising:

an electronic processing system associated with a vehicle engine, the electronic processing system including one or more processors and one or more data buses;

a control system having a controller operatively connected to the engine;

a monitoring system having a sensor operatively connected to the engine; and a diagnostic system in communication with the control system through the one or more data buses, wherein the diagnostic system is configured to implement, through the one or more processors, a sensor diagnostic procedure that includes a sensor health test, wherein the sensor health test causes engine components to operate under a test condition outside of normal vehicle operation and wherein one or more of the engine components are operated in a condition outside of a normal range, and the sensor health test records sensor data during the test condition, and wherein the sensor health test includes comparing a measured value of the sensor to an expected value and determining the health of the sensor based on the difference between the measured value and the expected value.

2. The engine diagnostic system of claim 1, wherein the sensor health test causes the engine to operate outside normal values or ranges.

3. The engine diagnostic system of claim 1, wherein the test condition includes an engine speed condition and an engine load condition.

4. The engine diagnostic system of claim 1, wherein the test condition includes actuator and valve positions.

5. The engine diagnostic system of claim 1, wherein the test condition includes adjusting an exhaust gas recirculation mode.

6. The engine diagnostic system of claim 1, wherein the sensor health test includes a portion that gathers data in a key on engine off condition.

7. The engine diagnostic system of claim 6, wherein the data includes barometric pressure data.

8. The engine diagnostic system of claim 7, wherein the health of the sensor is determined by a pressure measurement confidence value.

9. The engine diagnostic system of claim 1, wherein the sensor diagnostic procedure includes a telematics data analysis.

10. The engine diagnostic system of claim 9, wherein the telematics data analysis includes comparing data shifts over time, comparing sudden data shifts, comparing data exceeding a threshold, and comparing data to similar machines from the sensor.

11. An engine diagnostic system comprising:

an electronic processing system associated with an engine, the electronic processing system including one or more processors and one or more data buses;

a control system having a controller operatively connected to the engine;

a monitoring system having a sensor operatively connected to the engine; and a diagnostic system in communication with the control system through the one or more data buses, wherein the diagnostic system is configured to implement, through the one or more processors, a sensor diagnostic procedure that includes a telematics data analysis, wherein the telematics data analysis includes storing data from the sensor and analyzing the sensor data over a time period to determine the health of the sensor, wherein the sensor diagnostic procedure includes a first portion that gathers data in a key on engine off condition, and wherein the sensor health test causes an engine component to operate under a test condition outside of a normal operating range and records sensor data during the test condition.

12. The engine diagnostic system of claim 11, wherein analyzing the sensor data includes comparing data shifts over time.

13. The engine diagnostic system of claim 11, wherein analyzing the sensor data includes comparing data exceeding a threshold.

14. The engine diagnostic system of claim 11, wherein analyzing the sensor data includes comparing sudden data shifts.

15. The engine diagnostic system of claim 11, wherein analyzing the sensor data includes comparing data to similar machines.

16. The engine diagnostic system of claim 11, wherein the sensor diagnostic procedure includes a sensor health test and the sensor health test includes comparing a measured value of the sensor to an expected value and determining the health of the sensor based on the difference between the measured value and the expected value.

17. The engine diagnostic system of claim 16, wherein the sensor health test causes the engine to operate under a test condition and records sensors data during the test condition.

18. A method of diagnosing an engine sensor comprising:

receiving sensor data from a sensor at an engine control unit associated with a vehicle, wherein the sensor and the engine control unit are associated with an engine;

storing the received sensor data; and implementing a sensor diagnostic procedure that includes a telematics data analysis and a sensor health test, wherein the telematics data analysis includes analyzing the stored sensor data over a time period to determine the health of the sensor, and wherein the sensor health test causes engine components to operate under a test condition outside of normal vehicle operation and wherein one or more of the engine components are operated in a condition outside of a normal range, records sensor data during the test condition, and compares the recorded sensor data to an expected value and determines the health of the sensor based on the difference between the recorded value and the expected value.

19. The method of claim 18, wherein the telematics data analysis includes comparing data shifts over time, comparing sudden data shifts, comparing data exceeding a threshold, and comparing data to similar machines from the sensor.

20. The method of claim 18, wherein the sensor health test includes gathering data in a key on engine off condition.

* * * * *